United States Patent [19]

Charbonnier et al.

[11] Patent Number: 4,889,177

[45] Date of Patent: Dec. 26, 1989

[54] METHOD AND APPARATUS FOR SAND MOULDING COMPOSITE ARTICLES WITH A DIE MADE OF LIGHT ALLOY AND A FIBROUS INSERT

[75] Inventors: Jean Charbonnier, Voreppe; Francois Goliard, Le Grand Lemps, both of France

[73] Assignee: Cegedur Societe de Transformation de L'Aluminium Pechiney, Paris, France

[21] Appl. No.: 203,074

[22] Filed: Jun. 7, 1988

[30] Foreign Application Priority Data

Jun. 11, 1987 [FR] France ..... 87 08749

[51] Int. Cl.[4] ..... B22D 19/02

[52] U.S. Cl. ..... 164/97; 164/112; 164/119; 164/309; 164/306; 164/334

[58] Field of Search ..... 164/119, 306, 307, 308, 164/309, 310, 311, 97, 98, 112, 332, 334, 41, 155, 457

[56] References Cited

U.S. PATENT DOCUMENTS

| | | | |
|---|---|---|---|
| 4,050,503 | 9/1977 | Balevski et al. | 164/119 |
| 4,252,173 | 2/1981 | Charbonnier | 164/457 |

FOREIGN PATENT DOCUMENTS

| | | | |
|---|---|---|---|
| 56-47262 | 4/1981 | Japan | 164/309 |
| 57-28662 | 2/1982 | Japan | 164/306 |
| 61-119369 | 6/1986 | Japan | 164/112 |
| 1037222 | 8/1983 | U.S.S.R. | 164/119 |

*Primary Examiner*—Richard K. Seidel

*Attorney, Agent, or Firm*—Dennison, Meserole, Pollack & Scheiner

[57] ABSTRACT

The invention relates to a method and apparatus for sand molding composite articles formed of a light alloy metal and fibrous insert. A sand mold is formed containing a fibrous preform separated from the walls of the mold cavity. The mold is fed by means of a tube dipping into a liquid metallic bath therebelow. In the molding process, the pressure in the mold cavity and above the bath are reduced, and the pressure above the bath is increased to create a positive pressure differential ΔP, thereby forcing molten metal from the bath into the mold cavity. The pressure in the mold cavity and above the bath are then increased to above atmospheric, and the pressure differential ΔP is maintained until the metal in the mold cavity solidifies.

5 Claims, 2 Drawing Sheets

METHOD AND APPARATUS FOR SAND MOULDING COMPOSITE ARTICLES WITH A DIE MADE OF LIGHT ALLOY AND A FIBROUS INSERT

The invention relates to a method and apparatus for sand moulding composite articles with a die made of light alloy and a fibrous insert.

Alloys based on light metals such as aluminium or magnesium are being used more and more widely , e.g. for making pieces of equipment for ground and air transport means, particularly because they reduce the energy consumption required to drive those means. However these alloys have certain failings such as:

bad high temperature resistance
low fatigue resistance
poor resistance to wear by friction
a low modulus of elasticity.

Hence persons skilled in the art have sought to obtain great improvements in the properties of these articles, by reinforcing the alloys with fibres or ceramic particles so as to form composite articles with a metal die.

The articles can be obtained by several processes, including three which involve moulding in liquid phase. These are:

moulding-forging or squeeze casting,
compocasting,
infiltration under gas pressure.

The first of these processes produces highly reinforced articles with good properties, but the shape and size of the articles are limited. The second is designed to produce composites reinforced with particles or short fibres which are dispersed throughout the whole article. The third is the only possible process for making articles of complicated shapes, of large dimensions or with local reinforcement, but the pressures which can be applied are limited.

Applicants are more particularly interested in manufacturing composite articles reinforced by long fibres in a traditional sand mould, by applying the gas infiltration principle.

They have been confronted by two types of problems:

the first is to prevent the insert from being displaced inside the mould by the effect of the thrust exerted by the liquid metal during casting. This can be done by making a rigid preforming tool, which is fixed at certain points to the wall of the mould cavity, like conventional cores designed to form hollows inside articles;

the second problem is the pressure to be exerted on the liquid metal to make it penetrate into the tufts of the fibres; the smaller the diameter of the fibres, the larger the amount of reinforcement and the stronger the interfacial tension between metal and fibre, the higher the pressure has to be. The solution envisaged then comprises casting the articles under low pressure and increasing the injection pressure.

Yet these solutions have two serious drawbacks:

firstly, the fibres cannot be totally impregnated since the metal starts by completely covering the preforming tool before penetrating inside it, hence air is imprisoned inside the preforming tool so that infiltration of the metal ceases when the pressure of that air is equal to the pressure exerted on the liquid metal;

secondly, the pressure exerted cannot be too high, for the mould and cores are made of sand and consequently porous, so they are in danger of being impregnated by the metal, even in the presence of certain coatings, which means that the articles thus obtained will have bad surface condition.

As a means of overcoming these difficulties, Applicants have invented a method and apparatus enabling a strong pressure to be applied to the preforming tool while at the same time limiting the pressure exerted by the metal on the mould.

The method, using a sand mould which contains a fibrous preforming tool separated from the walls of the mould cavity, and which is fed by means of a tube dipping into a liquid metallic bath contained in a furnace, is characterised in that low pressure is created in the mould and above the bath, the pressure above the bath is increased to give a positive pressure difference $\Delta P$ relative to the mould and thus force the metal into the mould, then the pressure is increased to above atmospheric in the mould and above the bath simultaneously, and the same difference $\Delta P$ is maintained until the article solidifies.

Thus the invention comprises first bringing the pressure prevailing in the mould and above the bath to a value below atomospheric pressure. Owing to the permeability of sand, it is sufficient to put the outside of the mould under low pressure in order to obtain this result inside the cavity and consequently inside the preforming tool, which is naturally permeable to gases. It is preferable to attempt to reach a maximum residual pressure of $3\times10^3$ Pa.

The residual pressure is then increased above the bath by forming an air inlet, e.g. in the furnace, so that the positive pressure difference $\Delta P$ thus created above the bath relative to the mould makes the metal rise in the tube and enter the mould cavity. Since the preforming tool has no contact with the walls of the cavity it is completely surrounded with liquid metal, which prevents any gas from passing through.

The value of $\Delta P$ is preferably from $5\times10^3$ Pa to $1.5\times10^5$ Pa. The pressure is then increased above the bath and around the mould simultaneously and the difference $\Delta P$ is maintained. The pressure is preferably increased to a value between 3 and 20 times atmospheric pressure. Under these conditions the gas passes through the permeable walls of the mould and the infiltration pressure exerted by the metal on the mould maintains its value $\Delta P$. On the other hand, since the inside of the preforming tool is still under pressure and is not in communication with the outside, the infiltration pressure of the tool has a value P much larger than $\Delta P$. The required results are thus obtained, namely:

the metal penetrates right to the centre of the preforming tool, giving better cohesion between insert and die;

there is low mould infiltration pressure, thus preventing metal penetration of the mould and cores and giving the articles better surface condition.

the article solidifies under isostatic pressure, thus giving a more homogeneous structure.

The invention also concerns apparatus for carrying out the method described above. The apparatus is characterised in that it comprises:

a sand mould containing in its cavity a fibrous preforming tool with all its surfaces separated from the walls of the cavity, the mould being placed in a sealed chamber connected to a pipe in communication with means putting under pressure or under low pressure.

an electrically heated furnace placed below the mould and containing a bath of the metal to be moulded a tube rigidly connected to the mould, communicating with the cavity at one end and dipping into the bath at the other, the assembly being contained in a sealed enclosure fitted with a pipe in communication with means for putting under pressure or under low pressure, the two pipes being interconnected by a differential manometer.

Thus the apparatus comprises a sand mould made from normal materials such as silica, alumina, zirconium, olivine etc., in a state in which they are divided and bonded together either by an organic resin or by an inorganic bonding agent, e.g. of the sodium silicate, colloidal silica, ethyl silicate or phosphate type.

A mass of ceramic fibres is placed in the mould cavity, the fibres preferably being long, of the graphite, silicon carbide, alumina or similar type and suitably shaped for reinforcing the article. This preforming tool is arranged inside the cavity and kept away from the walls of the mould by any suitable means. In this way its walls can be completely covered by the metal during the casting of the article, and the tool can be kept impervious vis à vis the mould, an indispensible condition in carrying out the above method.

The mould is confined in a sealed chamber fitted with a pipe which is connected e.g. to a vacuum pump or a compressor. A tube also extends from the chamber; it is rigidly connected to the mould and connects the cavity to the bath of metal to be moulded, providing the feed to the cavity. The mould may be fitted with heating means designed to carry out preheating before the metal is introduced; this slows down solidification of the article and thus facilitates impregnation of the preforming tool and formation of thin walls.

The apparatus according to the invention further comprises an electrically heated furnace containing the metal to be moulded and located below the mould. The furnace may equally be positioned in a chamber similar to that of the mould. However it is also possible to confine it, as it is, in a sealed enclosure together with the mould surrounded by its chamber. Two pipes pass out of the enclosure and are connected to means for putting under pressure or under low pressure via control valves: the first pipe is that of the mould chamber and the second is for the furnace atmosphere. The two pipes are interconnected by a differential manometer.

In operation, once the preforming tool has been placed in the cavity, the mould closed and the furnace heated and filled with metal, the cavity is closed with a lid then the two pipes are connected to means for putting under low pressure. The manometer remains at zero. The enclosure pipe is then separated from the means for putting under low pressure and opened to the atmosphere long enough for the manometer to show a pressure of $\Delta P$. During this time the metal is forced from the furnace to the mould. With the connection with the atmosphere closed and the chamber pipe separated from the means for putting under low pressure, the two pipes are connected to the means for putting under pressure and the manometer is kept at value $\Delta P$ with the aid of the control valves.

When the article has solidified in the mould, the two pipes are separated from the means for putting under pressure and are put under atmospheric pressure. The enclosure and the mould are then opened successively and the article extracted.

A special means for obtaining imperviousness between the preforming tool and the mould with the aid of the metal is to fit the cavity with seats, the surfaces of these seats being provided with juxtaposed metal sheets which extend inside the cavity. The ends of the preforming tool are then put into contact with the sheets. Thus when the metal fills the mould it seals the sheets together and the seats become gastight; the preforming tool has no contact with the walls of the mould, which might allow gases to enter when pressure is applied.

The invention is illustrated in the accompanying drawings, in which.

Figure 1:
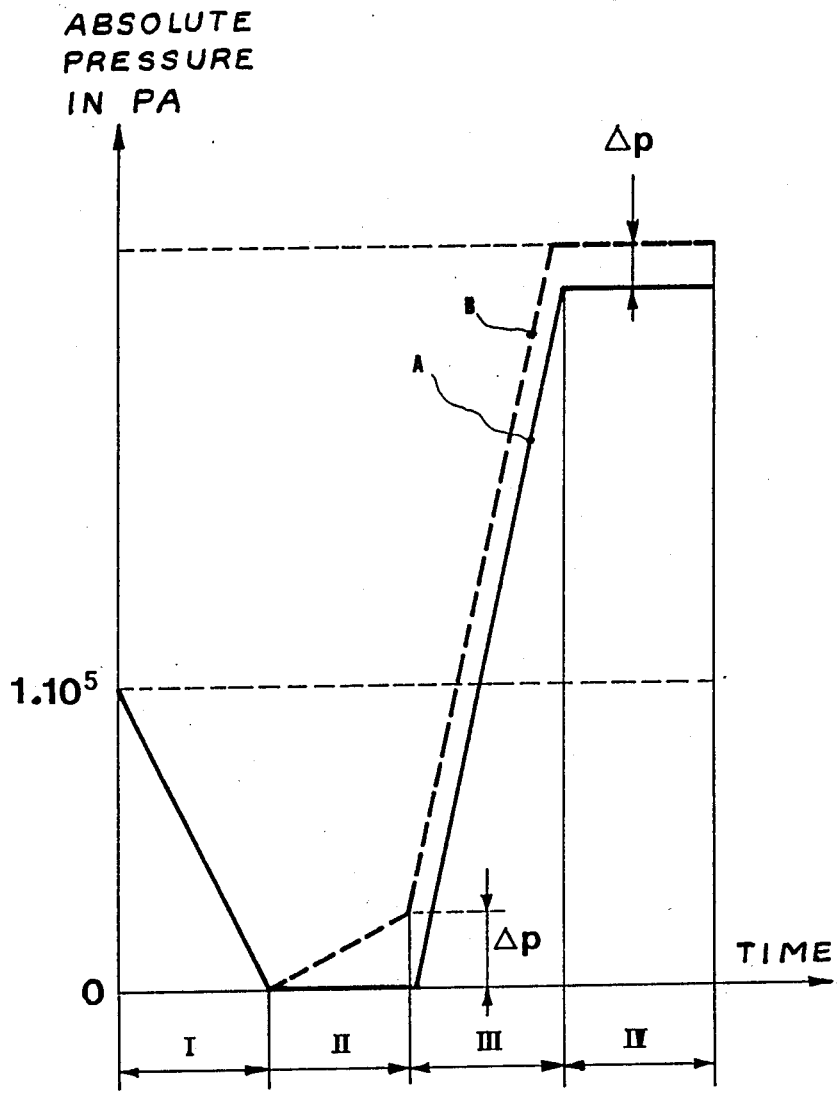
FIG. 1 shows the pressure v. time curves during a moulding operation.

More specifically:

FIG. 1 shows in continuous lines the curve A for the absolute pressure in Pa applied to the cavity, and in broken lines the curve B for the absolute pressure in Pa applied above the bath during the four phases of the process: I putting the furnace and mould under pressure - II sucking the metal into the mould - III infiltration of the insert by the metal - IV solidification of the article.

During the last phase the pressure exerted on the preforming tool, which is virtually equivalent to the maximum of the curve B, is much higher than that exerted on the walls of the mould, which is equal to $\Delta P$.

Figure 2:
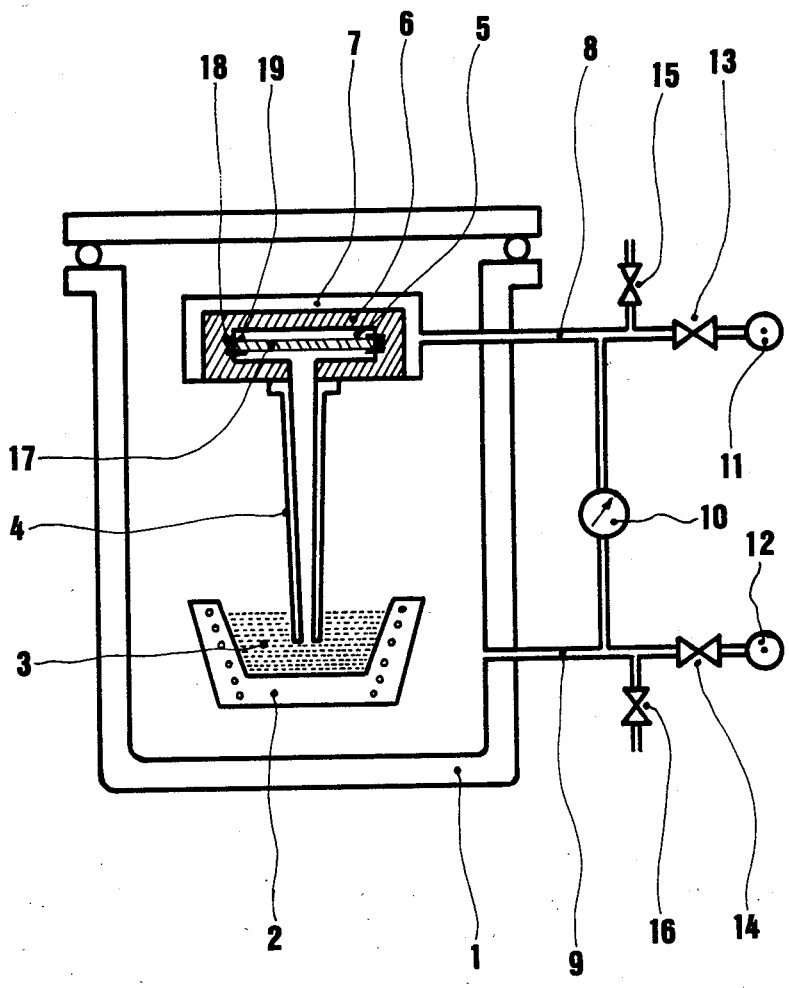
FIG. 2 is a vertical section through a moulding apparatus.

FIG. 2 shows the sealed enclosure 1 in which is placed the furnace 2 containing a receptacle 3 for the metal bath into which the tube 4 dips, the tube being connected to the cavity 5 of the mould 6 confined in the sealed chamber 7. The pipe 8 extending from the chamber 7 and the pipe 9 extending from the enclosure 1 are connected by the differential manometer 10 and each communicates separately with means 11 for putting under pressure or means 12 for putting under low pressure, via separating valves 13 and 14 and valves 15 and 16 for putting under atmospheric pressure.

The fibrous preforming tool 17 is disposed inside the cavity with its ends positioned in the seats. The seats are formed by metallic sheets 18 extending along 19 inside the cavity.

The invention can be used to obtain articles by sand moulding, with good cohesion between the insert and the die.

We claim:

1. A method of casting composites of a light alloy metal with a fibrous insert, comprising:

(a) providing a furnace containing molten metal bath, a sand mold having walls forming a mold cavity and a fibrous perform in the mold cavity separate from the walls and a tube connecting the mold cavity and molten metal in the furnace;

(b) reducing the pressure in the mold cavity and above the bath;

(c) increasing the pressure above the bath to create a positive pressure differential $\Delta P$ relative to the mold cavity and thereby force molten metal from the bath into the mold cavity;

(d) simultaneously increasing the pressure to above atmospheric pressure in the mold cavity and above the bath; and (e) maintaining the differential $\Delta P$ until the metal in he mold cavity solidifies.

2. The method of claim 1, wherein when the low pressure is created, the residual pressure in the mold cavity or above the bath is at most equal to $3\times10^3$ Pa.

3. The method of claim 1, wherein the value of $\Delta P$ is from $5\times10^3$ Pa to $1.5\times10^3$ Pa.

4. The method of claim 1, wherein the pressure is increased to a value between 3 and 20 times atmospheric pressure.

5. Apparatus for casting a composite of a light alloy metal with a fibrous insert, comprising:

(a) a sealed enclosure fitted with a first pipe connecting the enclosure with a means for increasing and decreasing the pressure within said enclosure;

(b) a sealed chamber within said enclosure, said chamber fitted with a second pipe connected to a means for increasing and decreasing the pressure within said chamber;

(c) a differential manometer connected between said first and second pipes;

(d) a sand mold having walls defining a mold cavity and located within said sealed chamber, said cavity having seats equipped on their surfaces with juxtaposed metal sheets which extend along the walls of the cavity and which are adapted to hold a fibrous preform in the cavity separate from the walls;

(e) an electrically heated furnace in said enclosure below said chamber, said furnace including a receptacle for containing a molten bath of a light alloy metal; and (f) a tube rigidly connected to the mold and communicating with the mold cavity at one end and the receptacle at the other end.

* * * * *